US009643374B2

(12) United States Patent
Barrer et al.

(10) Patent No.: US 9,643,374 B2
(45) Date of Patent: May 9, 2017

(54) DEVICE AND METHOD FOR PROCESSING FLAT PRODUCTS

(71) Applicant: MULTIGRAF AG, Muri (CH)

(72) Inventors: Daniel Barrer, Muri (CH); Ivan Coric, Wohlen (CH)

(73) Assignee: MULTIGRAF AG, Muri (CH)

( * ) Notice: Subject to any disclaimer, the term of this patent is extended or adjusted under 35 U.S.C. 154(b) by 673 days.

(21) Appl. No.: 13/720,022

(22) Filed: Dec. 19, 2012

(65) Prior Publication Data

US 2013/0165310 A1 Jun. 27, 2013

(30) Foreign Application Priority Data

Dec. 27, 2011 (EP) ..... 11195825

(51) Int. Cl.
*B31D 99/00* (2017.01)
*B31F 1/08* (2006.01)

(52) U.S. Cl.
CPC ..... *B31D 99/00* (2013.01); *B31F 1/08* (2013.01)

(58) Field of Classification Search
CPC .. B31F 1/08; B31F 1/0025; B31F 5/02; B31F 5/027; B31F 2201/0797; B31F 2201/0794; B31D 99/00; B65H 45/30; B65H 45/28; B65H 45/18; B65H 79/00; B65H 2402/341; B65H 2402/10; B65H 2402/32; B65H 2402/52; B26D 3/06; B26D 3/08; B23D 35/008
USPC ..... 493/468
See application file for complete search history.

(56) References Cited

U.S. PATENT DOCUMENTS

| | | | | |
|---|---|---|---|---|
| 6,609,997 | B1 * | 8/2003 | Sardella | B24B 53/04 493/355 |
| 2003/0092551 | A1 * | 5/2003 | Boss | 493/424 |
| 2003/0139274 | A1 * | 7/2003 | Cipolli | 493/434 |
| 2003/0177918 | A1 * | 9/2003 | Teshima | 101/30 |

(Continued)

FOREIGN PATENT DOCUMENTS

| | | |
|---|---|---|
| GB | 2 373 759 A | 10/2002 |
| JP | A-2008-279715 | 11/2008 |
| WO | WO 2007/042391 A1 | 4/2007 |

OTHER PUBLICATIONS

Multigraf E360 & E460 Creasing and Perforating machine, Youtube, Aug. 2011, http://www.youtube.com/watch?v=vse_AkoA3fY.

(Continued)

*Primary Examiner* — Michelle Lopez
*Assistant Examiner* — Chinyere Rushing-Tucker
(74) *Attorney, Agent, or Firm* — Oliff PLC

(57) ABSTRACT

The device, which serves for processing flat products, particularly separated sheets of paper, includes a device body that is holding a tool, with which the flat products can be processed. The inventive device further includes a tool bearing that is connected to the device body and that includes at least one bearing drive unit, a control unit controlling the bearing drive unit, a tool drive unit and a modular tool unit that includes said tool and that can be actuated by the tool drive unit when it is coupled to the tool drive unit, wherein the modular tool unit is releasably held by the tool bearing and is movable by the bearing drive unit towards the tool drive unit under the control of the control unit until it is coupled with the tool drive unit.

15 Claims, 5 Drawing Sheets

(56) References Cited

U.S. PATENT DOCUMENTS

Figure 1B:
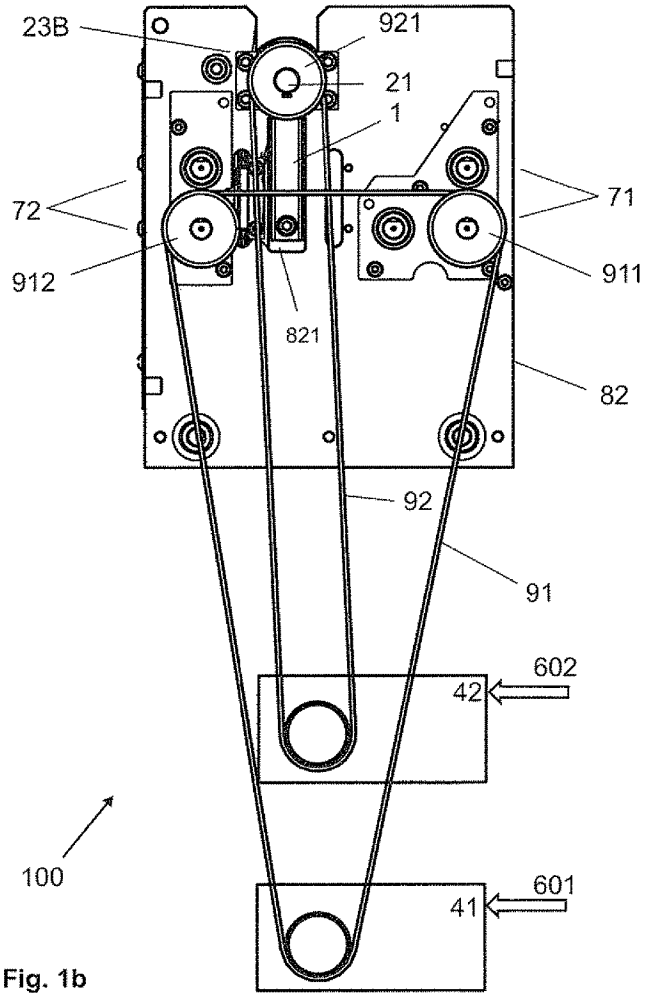

| | | | | |
|---|---|---|---|---|
| 2004/0256058 | A1* | 12/2004 | Irwin et al. | 493/189 |
| 2005/0103173 | A1* | 5/2005 | Elkis | B23D 35/008 83/343 |
| 2009/0181840 | A1* | 7/2009 | Awano | B31F 1/08 493/399 |
| 2010/0119276 | A1* | 5/2010 | Sasahara | B65H 45/18 493/442 |
| 2012/0048131 | A1* | 3/2012 | Diehr et al. | 101/3.1 |
| 2012/0053034 | A1* | 3/2012 | Diehr et al. | 493/55 |
| 2012/0115702 | A1* | 5/2012 | Ishikawa | B31F 1/08 493/405 |

OTHER PUBLICATIONS

Multigraf AG, Presentation Multigraf Touchline CF375, Date unknown.

* cited by examiner

DEVICE AND METHOD FOR PROCESSING FLAT PRODUCTS

The invention relates to a device and a method for processing, particularly for creasing, perforating or cutting flat products, particularly products made of paper, cardboard or plastic, which are forwarded as separated items or continuously to the device for processing in order to obtain a finished product.

In the paper industry it is often required to cut, perforate or fold sheets of paper. Before folding, preferably a crease is formed in the sheets of paper, along which the paper can then precisely be folded. For this purpose, sheets of paper accommodated in a stack of a stapling device are fed to a creasing device, which forms one or a plurality of creases into the sheets and then forwards the sheets to a folding device, as it is described for example in the presentation of product Touchline CF375 manufactured by Multigraf AG, CH-5630 Muri.

GB2373759A discloses a creasing machine with a creasing mechanism, a transport mechanism with input rollers and output rollers for transporting documents through the creasing mechanism, and control means for controlling operation of the creasing mechanism and the transport mechanism. The creasing mechanism comprises a first creasing element that is moveable towards a second creasing element for producing a crease in a document located between the creasing elements, and a drive mechanism for driving the moveable creasing element. During operation of the creasing machine, the arrival of a document is detected and signalled by means of a sensor, so that the control means can monitor its position and can activate the creasing mechanism at the moment, when a zone of the document to be processed has reached the creasing tools.

The device disclosed in GB2373759A is only used for creasing. In the event that creases are not embossed with a desired depth, then the device is opened and the creasing mechanism is adjusted by means of a tool, which requires considerable time and effort. Re-adjustments are typically required, if the properties of the product have changed. Further, in the event that another kind of crease shall be embossed into the documents, then the tools are exchanged, again requiring considerable time and effort.

In the machine disclosed in GB2373759A the documents are always stopped before the creasing mechanism is activated. A device disclosed in US20030092551A1 however allows processing the products while they are conveyed. Both modes of operation exhibit advantages and disadvantages. Completely stopping the product allows precise machining but requires relatively much time. However, processing products without loss of time while they are conveyed requires rather complex and costly tools, such as rotating type or pendulum type of tools. In the event that the tools, which are running in parallel to the products, do not operate precisely, then the processed products may show deficiencies.

The present invention is therefore based on the object of providing an improved device and an improved method for processing flat products.

In particular a device for processing flat products shall be created that can be adapted preferably automatically or with minimal manual effort to changing requirements of the user and/or to changing properties of a product. Changes of the working processes shall be performed preferably automatically or with minimal effort and time.

The device shall be applicable for all processes for processing flat materials such as paper, printed products, cardboard, plastic such as plastic foils and thin metal layers such as metal foils. The inventive device shall be able to perform various working processes, such as cutting, creasing or perforating flat objects, in different configurations that can be reached with minimal effort.

Still further it shall be possible to perform adjustments preferably automatically with which working processes can be optimised or adapted to the user's requirements.

The device shall deliver optimal processing results independently of external influences, such as influences of temperature, and/or humidity, or tolerances of the products.

Further, the device shall allow processing the products with short operation cycles and with a high throughput. Thereby, the device shall exhibit a simple construction and shall require little maintenance.

This problem is solved with a device and a method as defined in claim 1 and claim 15. Further, preferred embodiments of the invention are defined independent claims.

The device, which serves for processing flat products, particularly separated sheets of paper, comprises a device body that is holding a tool, with which the flat products can be processed.

The device further comprises a tool bearing that is connected to the device body and that comprises at least one bearing drive unit, a control unit for controlling the bearing drive unit, a tool drive unit and a modular tool unit that comprises said tool and that can be actuated by the tool drive unit when it is coupled to the tool drive unit. The modular tool unit is releasably held by the tool bearing and is movable by the bearing drive unit towards the tool drive unit under the control of the control unit until it is coupled with the tool drive unit.

Hence, the device can selectively be equipped with different tool units, in order to process products as required, particularly for creasing, perforating and cutting the products. With a few external manipulations the device can be transformed between several embodiments, e.g. the embodiment of a creasing machine, the embodiment of a perforating machine or the embodiment of a cutting machine.

In a preferred embodiment the tool bearing comprises a bearing block, which is slidably held and which can receive and hold the modular tool unit, and at least one bearing drive unit, with which the bearing block is movable in such a way that the modular tool unit can be coupled to the tool drive unit and can be adjusted as required. By lifting the bearing block the modular tool unit is guided towards the tool drive unit and can be provided with an initial load so that the operation of the tool can be adapted to the properties of the product and/or to the properties of the tool parts.

In a preferred embodiment the bearing block comprises a tool channel that can receive the modular tool unit. Preferably, the tool channel and the thereto corresponding part of the modular tool unit are adapted in a form locking manner to one another so that the modular tool unit, when inserted into the bearing block, is securely held. In addition or alternatively the bearing block is provided with at least one magnet, with which the inserted module tool unit is firmly coupled to the bearing block. Preferably, a plurality of receiving openings is provided within the tool channel, in which magnets are seated. After insertion into the device, the modular tool unit is automatically held and fixed at a predetermined position.

The modular tool unit comprises two tool holders that are connected with one another and are movable against one another. Between the tool holders at least one elastic element is arranged, with which the tool holders are pressed apart in the idle position. Only under the impact of the tool drive unit the tool holders are moved towards one another. While the second tool holder is preferably coupled to and firmly held by the tool drive unit, the first tool holder may be adjusted with the bearing drive unit in order to obtain a desired mutual engagement of the tool parts that are held by the tool holders. Thereby it can be adjusted that cutting tools or perforating tools are movable towards one another until a cut is executed completely. When creasing tools are used, then the bearing block can be adjusted in order to obtain a desired depth of the embossed crease.

With the inventive device, any suitable tool such as cutting tools, creasing tools or perforating tools can be used, which allow processing the products as required.

In a further preferred embodiment, at least one of the tool holders comprises a tool cavity, into which a related tool part can be inserted. This allows replacing a tool part within the modular tool unit with a simple manipulation after the modular tool unit has already been inserted into the device. For example, a first tool part comprising a first punching element can be replaced by a second tool part comprising a second punching element. In a preferred embodiment a removable tool part is provided, which comprises on one side the first punching element and on the opposite side the second punching element. In order to adapt the punching element to a production process, the tool part can be pulled out of the module tool unit and can be inserted again after it has been turned by 180°.

The modular tool unit exhibits a simple construction and can be assembled and maintained with little effort. In a preferred embodiment the first tool holder is connected on both ends with a mounting bracket, each comprising a guide channel on the sides facing one another. The second tool holder comprises a first and a second guide nose on opposite sides, which are slidably held in the related tool channels of the mounting brackets.

Elastic elements are arranged preferably between the corresponding ends on both sides of the cooperating tool holders. The tool holders are pressed apart by the elastic elements and are held in parallel alignment by the tool drive unit or, in the end position, by means of the mounting brackets so that the products can be transferred through a slit opening between the tool holders.

In the event that a removable first tool part is used, then preferably at least one of the mounting brackets is provided with a transfer opening, through which the first tool part can be inserted into the tool cavity of the first tool holder. In order to pass the first tool part by the elastic element located at the transfer opening, said elastic element is preferably sitting on a bridge element, which forms an entrance gate to the tool cavity.

The modular tool unit can be inserted into the device in such a way that the tool bearing supports the first or the second tool holder and the tool drive unit is coupled to the second or first tool holder respectively. Hence, the tool holders and the tool parts can be exchanged in order to reach a desired configuration of the device.

In a further preferred embodiment the tool drive unit comprises a drive shaft that holds at least one eccentric, which, when coupled to the modular tool unit, adjoins the modular tool unit. Preferably, each eccentric comprises a cylindrically formed eccentric body that is eccentrically connected to the drive shaft. With each turn of the drive shaft the eccentric body its extremity is guided downwards towards the modular tool unit or against the second tool holder respectively and back up again.

In order to actuate the second tool holder without friction losses, the eccentric is preferably provided with a wheel bearing that is rotatably holding a wheel that joins the modular tool unit, when activated. The eccentric therefore forms a wheel bearing for the wheel, which constantly adjoins the modular tool unit, when actuated. With each turn of the drive shaft an operating cycle is executed, e.g. for creasing or cutting a product. The tool drive unit exhibits in this embodiment a particularly simple construction. However, alternatively also other drive devices can be used, which can actuate the modular tool unit.

The device can be equipped with a conventional device body, conventional drive means and conventional transport means with input rollers and output rollers serving for conveying the products. Preferably the device body comprises two mounting plates that are connected with one another by means of transverse bars. Each mounting plate is provided preferably with a recess that allow the modular tool unit to pass through and to hold the modular tool unit preferably movable e.g. in vertical direction but laterally without play.

The device comprises a control unit, with which process measurands or process factors e.g. obtained with sensors, or process parameters selected by the user are processed, operating programs are run, and corresponding control signals are provided to the tool drive unit, the bearing drive unit and/or to at least one transport motor, with which the products are conveyed through the device.

In order to allow simple modification of the configuration of the device, the modular tool unit is preferably provided with an identification module, which contains or displays tool data of the modular tool unit, which tool data can be read or interrogated with a tool sensor and can be transferred to the control unit. The identification module may display a code such as a barcode that can be read with an optical sensor. Further, the identification module may comprise mechanical fingers that can be sensed mechanically or optically or that can actuate a sensor switch. Further, the identification module may be an electronic chip or an RFID-tag (radio frequency identification unit), which comprises identification data. For retrieving data the electronic chip may galvanically be contacted or may be interrogated inductively or by means of electromagnetic waves.

With the described technical means the bearing drive unit can automatically be actuated with regard to the tool data, in order to adjust for example an optimal mutual distance between the tool parts or to provide an initial load on the tool parts. In order to reach optimal work results, preferably further process factors, such as the properties of the product, the ambient temperature, the temperature of the tools or device elements and/or the ambient humidity are taken into consideration. Further, a sensor may preferably be provided, which senses the properties of the finished product and transmits corresponding data to the control unit.

According to the inventive method, the arrival of a product is detected with a sensor and subsequently the tool drive unit is started at a first point in time, at which the zone of the product to be processed is still remote from the modular tool unit. Then the transport motor is controlled in such a way that the product is stopped at a second point in time, at which the zone of the product to be processed has reached a position for processing between the two tool parts. The first point in time is selected in such a way that the tool parts are acting on the product at the second point in time or shortly afterwards. Immediately after the impact of the tool parts on the product the transport motor is restarted. For this purpose the turning angle of the drive shaft is preferably sensed with a sensor or calculated so that the separation of the tool parts at a third point in time can be determined and the transport motor can be restarted. In this manner a practically continuous operation results with a high throughput and the advantage that the products can still optimally be processed with simple means. By means of the tool data, the above described processes can advantageously be adjusted and optimised.

Figure 1A:
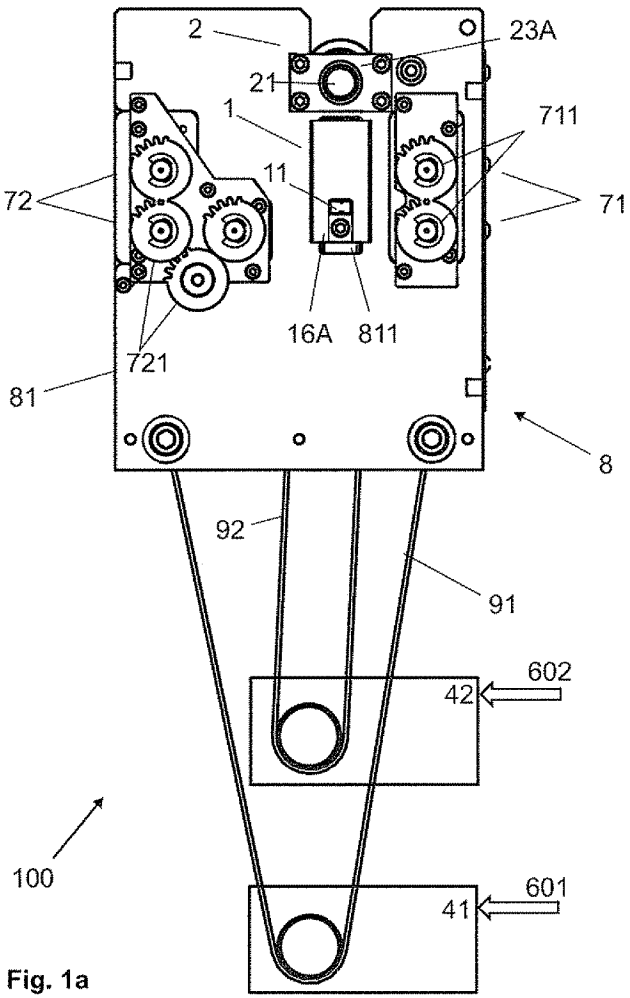
Figure 2:
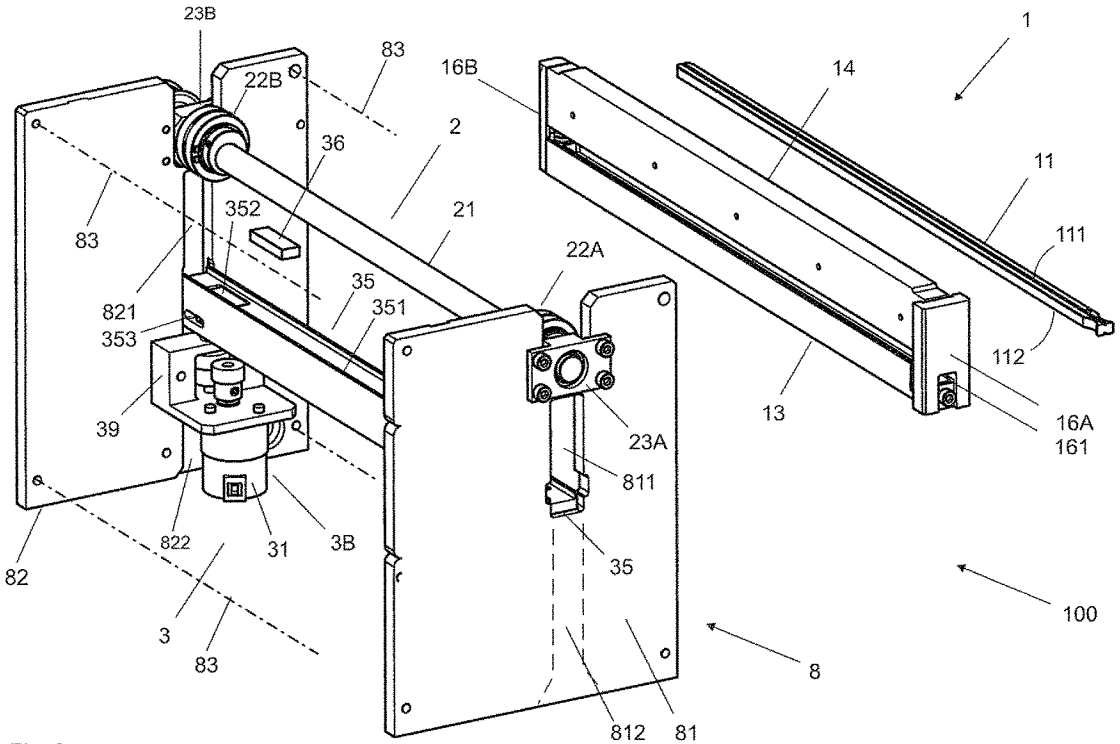
Figures 3, 3A:
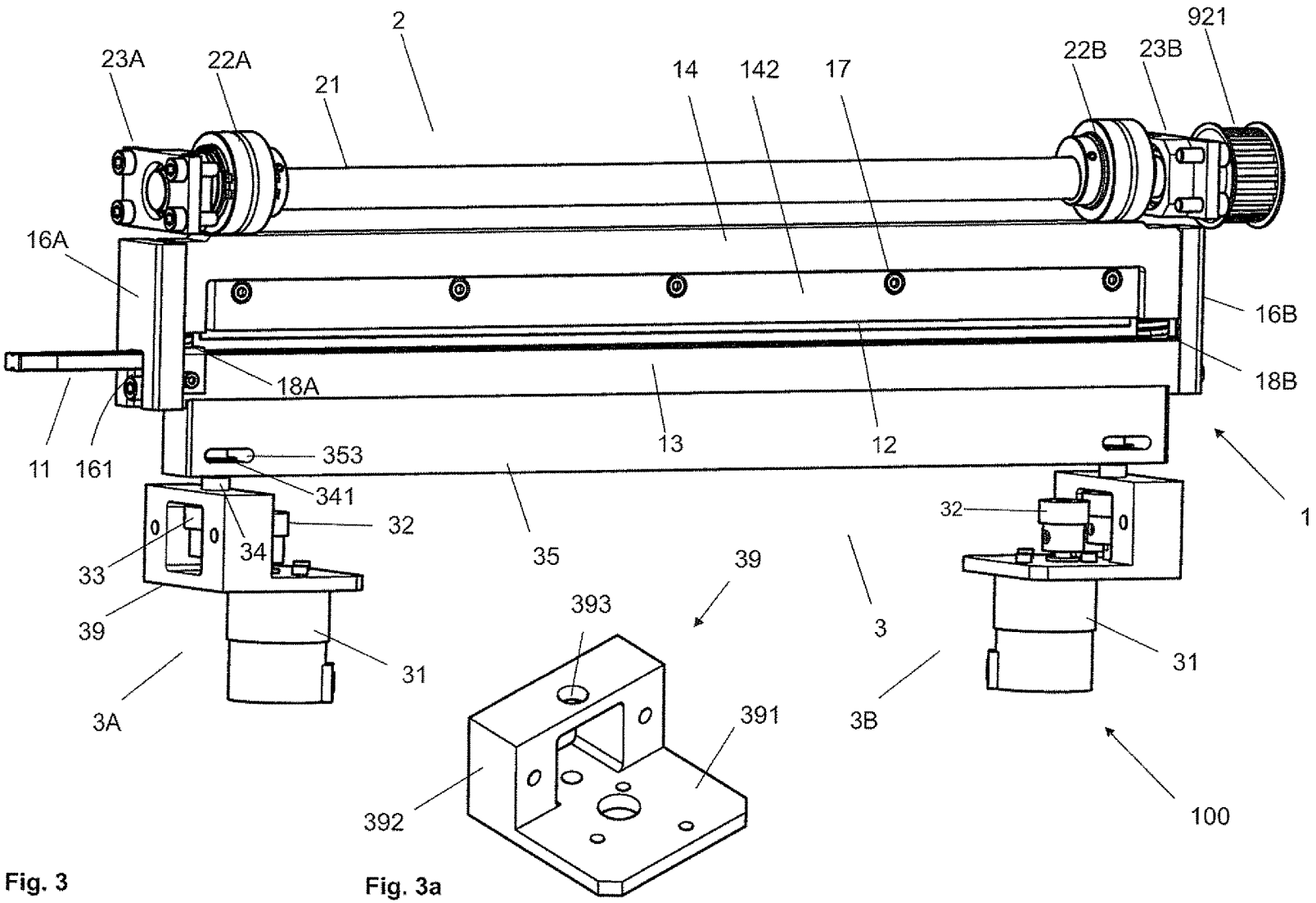
Figures 4, 4A:
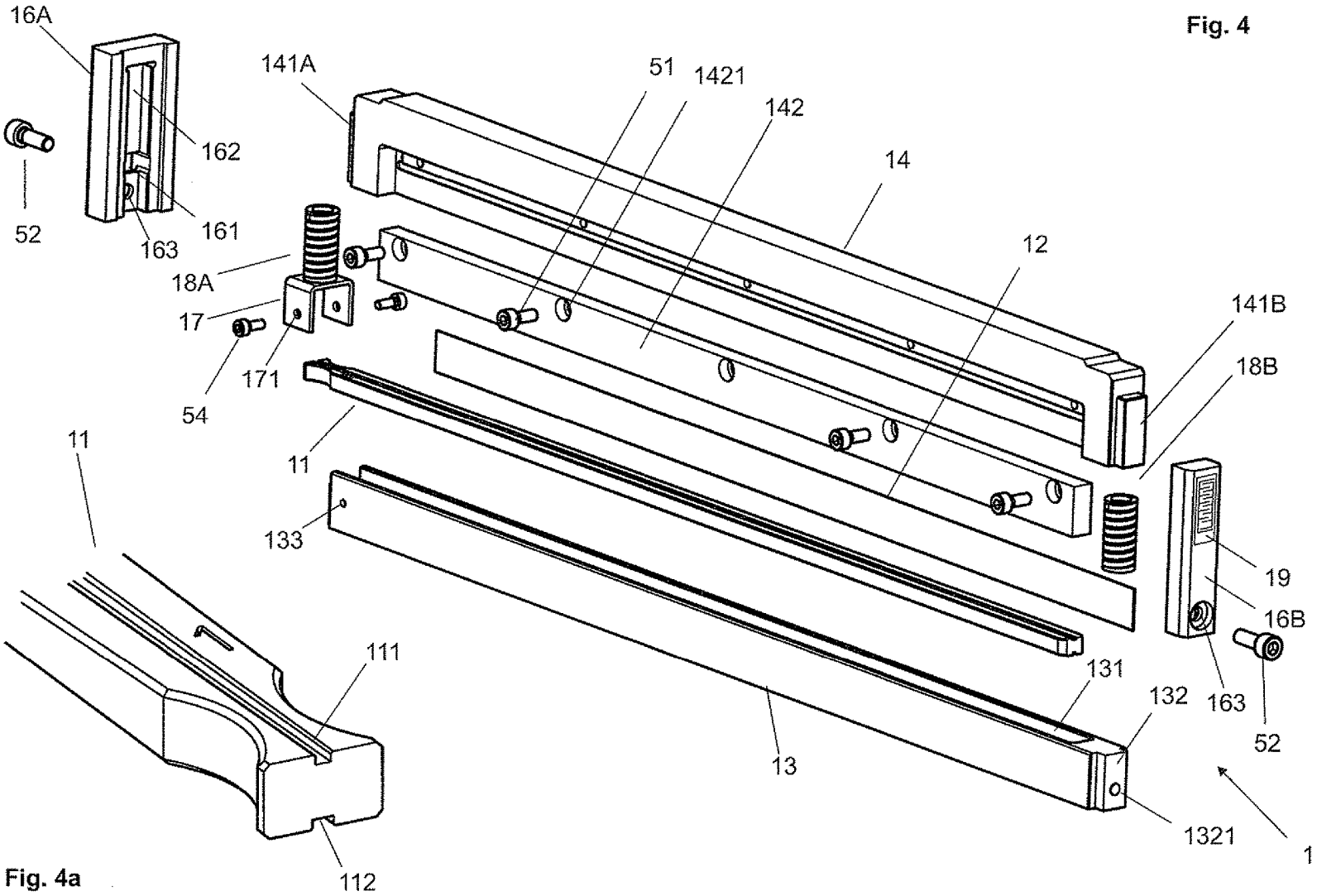
Figure 5:
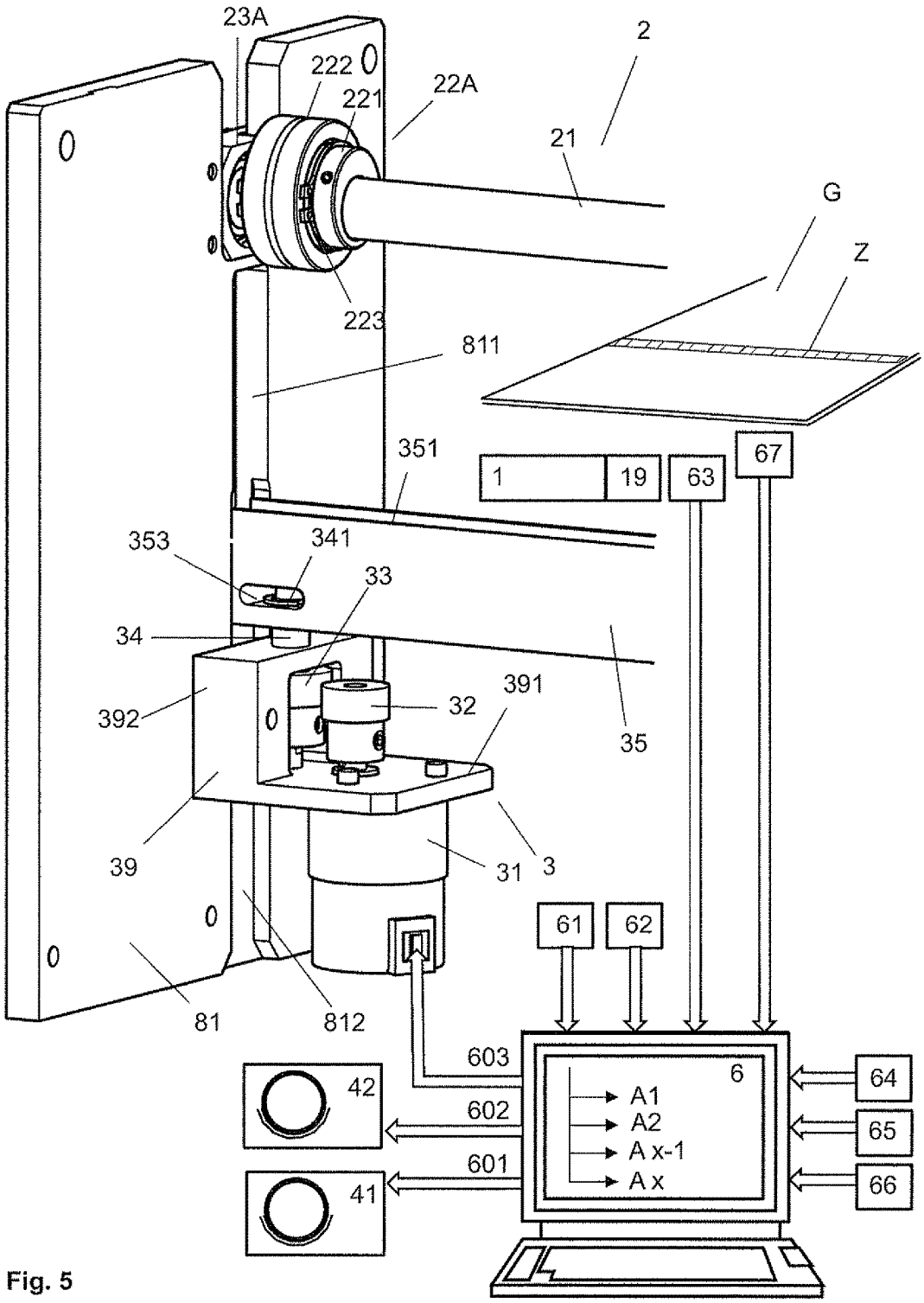

Below, the invention is described in detail with reference to the drawings. Thereby show:

FIG. 1*a*, 1*b* the inventive device 100 with a device body 8 shown from the front side and the rear side without housing, with an exchangeable modular tool unit 1 that has been inserted into the device body 8;

FIG. 2 the device 100 of FIG. 1*a* and 1*b* in spatial view with a tool drive unit 2 and a tool bearing 3, which serves for receiving the separately shown modular tool unit 1;

FIG. 3 the modular tool unit 1 of FIG. 2, which is held by the adjustable tool bearing 3 that comprises two drive units 3A, 3B and that is actuated by the tool drive unit 2;

FIG. 3*a* a mounting frame 39 used for the drive units 3A, 3B;

FIG. 4 an explosion view of the modular tool unit 1 of FIG. 2 comprising a first and a second tool holder 13 and 14 with a first tool part 11, which can be inserted in a first or a second alignment into the first tool holder 13;

FIG. 4*a* the front end of the first tool part 11 with a first tool region 111 on the upper side and a second tool region 112 on the lower side; and FIG. 5 a part of the device body 8 with the tool drive unit 2 and the tool bearing 3 of FIG. 3, with a control unit 6, which receives process data obtained from sensors 61, . . . , 67, such as tool data, product data, process parameters and process factors, for processing and which delivers control signals 601, 602, 603 to drive devices 31, 41, 42.

FIGS. 1*a* and 1*b* show an inventive device 100, which is designed for processing, particularly creasing and cutting flat products. FIG. 1*a* shows the device without housing from the front side. FIG. 1*b* shows the device 100 from the rear side.

The device 100 comprises a device body 8 with a front-sided mounting plate 81 (see FIG. 1*a*) and with a rear-sided mounting plate 82 (see FIG. 1*b*), that are connected with one another by transverse bars 83, as shown in FIG. 2.

Each of the mounting plates 81, 82 comprises a recess 811 or 821, into which a modular tool unit 1 can be inserted. Above the recesses 811, 821, shaft bearings 23A, 235 are mounted, which hold a drive shaft 21 of a tool drive unit 2.

Further, the device body 8 holds transport means, such as shafts with input rollers 71 and output rollers 72, with which products can be forwarded to the modular tool unit 1 and further to the output of the device 100. The transport means can be activated and driven as required. Such transport means are well known to a man skilled in the art for example from the documents cited above.

For processing the products in further process stages upstream or downstream of the first modular tool unit 1, further tools, preferably exchangeable modular tool units 1, can be used. FIG. 1*b* shows that the transport means 71, 72 are driven by a single transport belt 91. The transport belt 91 is coupled with a transport motor 41 and engages on the rear side of the device 100 in transport wheels 911, 912, which serve for driving the input rollers 71 and the output rollers 72 of the device 100 so that products can be conveyed through the device 100 and thereby processed by the at least one modular tool units 1.

Further, a tool motor 42 is provided, which is coupled via a tool belt 92 with a tool wheel 921 that is sitting on the drive shaft 21 of the tool drive unit 2. The transport means 71, 72, i.e. the input and output rollers, are coupled with one another via related tooth wheels 711; 721.

A control unit 6 delivers control signals or control voltages 601, 602 to the transport motor 41 and to the tool motor 42 so that the transport means 71, 72 and the tool drive unit 2 can individually be operated (see FIG. 4). The transport motor 41 and the tool motor 42 are preferably controlled in such a manner that the transport means 71, 72 can be stopped, before the tool drive unit 2 is set in motion or preferably before the modular tool unit 1 acts on the product. Further, a modular tool unit 1 can be used that allows processing the products without stopping them. The modular tool unit 1 can for example be equipped with two rolls that comprise creasing tools, which correspond to one another and which interact once with each turn executed.

FIG. 1*a* shows the modular tool unit 1 with a mounting bracket 16A on the front side that exhibits a transfer opening 161, out of which the front part of a first tool part 11 extends (see also FIG. 3).

FIG. 2 shows the device 100 of figures la and lb in spatial view with schematically shown transverse bars 83, which connect the two mounting plates 81, 82 of the device body 8 with one another. The modular tool unit 1 has been taken out of the device 100 and is shown separately. Further, from the modular tool unit 1 the first tool part 11 has been removed, which comprises on the upper side a first tool region 111 and on the lower side a second tool region 112. The modular tool unit 1 comprises on the front side and on the rear side each a mounting bracket 16A; 16B. The mounting bracket 16A on the front side comprises said transfer opening 161, through which the first tool part 11 is movable into the modular tool unit 1 .

FIGS. 2 and 3 show a tool bearing 3 with a horizontally aligned bearing block 35, which is slidably held in mounting channels 812, 822 that are provided in the mounting plates 81, 82 and that are facing one another. The mounting channel 812 in the first mounting plate 81 is schematically shown. The bearing block 35 can be moved vertically actuated by drive units 3A, 3B, so that the installed modular tool unit 1 can be coupled to the tool drive unit 2 that is arranged above the tool bearing 3. FIG. 2 shows that in this embodiment the bearing block 35 can be lifted up to the height of the recesses 811, 821 or further if required. It is further shown that a tool channel 351 is provided in the upper side of the bearing block 35, into which the modular tool unit 1, which comprises a first and a second tool holder 13, 14, can be inserted in such a way that the first tool holder 13 is held in the tool channel 351. For the firm seating of the first tool holder 13 in the tool channel 351, the first tool holder 13 and the tool channel 351 are preferably adapted to one another in a form-locking manner and may for example form a dovetail connection. However, in the shown embodiment the tool channel 351 comprises at least one recess 352, in which a magnet 36 is seated that holds the modular tool unit 1. With a lateral movement, the modular tool unit 1 can easily be released from the bearing block 35, i.e. from the magnets 36 and can be pulled through the recess 811 out of the device 100.

The two drive units 3A, 3B, with which the bearing block 35 can be lifted or lowered vertically, comprise each an electric motor 31, preferably a stepper motor, which is held at a related mounting frame 39 that is connected to the related mounting plate 81 or 82.

FIG. 3 shows the modular tool unit 1 that is supported by the tool bearing 3 and that is coupled to the tool drive unit 2, which is shown in FIG. 4 in an exploded view. For better visibility the two mounting plates 81, 82, to which the mounting frames 39 are connected, have been removed.

The mounting frames 39, of which one is shown in FIG. 3*a* in spatial view, comprises a motor plate 391 to which the electric motor 31 is screwed and a gear box 392, with a threaded bore 393, in which a threaded bolt 34 is rotatably held (see FIG. 3). The threaded bolt 34 holds an intermediate wheel 33, which is coupled to a drive wheel 32 driven by the electric motor 31.

The threaded bolt 34 is extending into a mounting opening 353 at the lower side of the bearing block 35. The mounting opening 353 comprises preferably the form of a bore having a side window, through which a locking ring 341 can be inserted in order to hold the threaded bolt 34 rotatable connected to the bearing block 35.

With each turn of the threaded bolts 34 of the two drive units 3A, 3B the bearing block 35 is lifted or lowered. When using stepper motors 31, the bearing block 35 and therefore the mounted modular tool unit 1 can be lifted towards the tool drive unit 2 and can also be adjusted precisely in height. With the stepper motors 31 the threaded bolts 34 can be turned by selected angles and therefore can vertically be shifted precisely. For changing the modular tool unit 1, the bearing block 35 is always driven into the initial position. For this purpose, positions switches can be used that detect the arrival of the bearing block 35 at a terminal position. Alternatively the motor current can be monitored, which strongly increases when an end stop or mechanical catch is reached.

The modular tool unit 1, which is shown in FIGS. 3 and 4 in a preferred embodiment, comprises a first and a second tool holder 13, 14 that are held by the mounting brackets 16A, 16B slidably against one another and that are pressed apart by means of elastic elements 18A, 18B, preferably by two helical springs.

The modular tool unit 1, i.e. the first tool holder 13 is seated on the preferably beam-shaped bearing block 35 and is pressed by the bearing block 35 against the tool drive unit 2, i.e. against two eccentrics 22A, 22B, which are held by a drive shaft 21. As described above, the drive shaft 21 is connected to a tool wheel 921, which is coupled via the tool belt 92 to the tool motor 42. When starting the tool motor 42 the drive shaft 21 with the eccentrics 22A, 22B is turned, so that the eccentrics 22A, 22B move the second tool holder 14 with each turn downwards and up again. By this movement, the force exerted by the tool drive unit 2 acts from above on the second tool holder 14, while the force exerted by the elastic elements 18A, 18B acts from below on the second tool holder 14.

As shown in the exemplary embodiment of FIG. 5, the eccentrics 22A, 22B comprise a cylindrical eccentric body 221, which is held with its axis in parallel but eccentric to the drive shaft 21. In order to avoid a friction on the second tool holder 14 and the eccentrics and thus to avoid abrasive wear, the eccentric body 221 is formed as a wheel bearing for an eccentric wheel 222, which is held in the exemplary embodiment on both sides with locking rings 223 and which is adjoining the second tool holder 14, while the eccentric body 221 is turned.

The drive shaft 21 is held on both sides with shaft bearings 23A, 23B, which, as shown in figures la, lb, are held in the recesses 811 and 821 of the mounting plates 81, 82.

FIG. 3 shows the compact construction of the modular tool unit 1 as well as the advantageous design of the tool bearing 3 and the tool drive unit 2. With the tool bearing 3, the modular tool unit 1 can be actuated and advantageously be adjusted. While the second tool holder 14 is adjoining the eccentrics 22A, 22B, the second tool holder 13 can selectively be lifted further with the tool bearing 3 in order to adjust the distance between the tool holders 13, 14 and therefore also the distance between the tool parts 11, 12 held by the tool holders 13, 14. In this way a desired interaction between the two tool parts 11, 12 during an operation cycle, i.e. during a turn of the drive shaft 21 can be adjusted. Particularly the depth of a cut or the depth of a crease in the products can precisely be adjusted. Furthermore, it is possible to adapt the distance between the tool parts 11, 12 to the quality of the products, whose properties can change during the course of processing depending on the ambient temperature, the ambient humidity or because of tolerances related to the production processes of the products.

All settings and adjustments can be executed automatically by controlling the tool bearing 3 accordingly. In order to exchange the modular tool unit 1 the bearing block 35 is lowered so that it can be removed. After inserting the next modular tool unit 1, this modular tool unit 1 is preferably automatically identified so that data for controlling the tool bearing 2 can be retrieved from the memory device of the control unit 6, which is further described below.

FIG. 3 further shows that the first tool part 11 can be removed and replaced through a transfer opening 161 provided in the front-sided mounting bracket 16A. The front part of the first tool part 11 extends out of the modular tool unit 1 can manually be removed, turned and inserted again. Therefore, the user can adapt the configuration of the device 100 within seconds in various ways with regard to his requirements and to the products and is thereby assisted by automatic control processes with which the newly inserted modular tool unit 1 is adjusted. Manipulations by hand inside the device 100, particularly manipulations with tools, are avoided. With the control unit 6 the device 100 is automatically adapted to the inserted modular tool unit 1 as well as to the requirements of the user and the processed products.

FIG. 4 shows the modular tool unit 1 in an explosion view. In this embodiment the modular tool unit 1 comprises the removable first tool part 11 and accordingly required construction features, particularly the transfer opening 161 in the front-sided mounting bracket 16A as well as the bridge element 17, through which the first tool part 11 can be inserted into the first tool holder 13 and on which the first elastic element 18A is seated. The bridge element 17, which is connected to the first tool holder 13 by means of screws 54 that are turned into threaded bores 133 in the present example, can also form a unitary part of the tool holder 13.

The two tool holders 13, 14 are held at both ends with the first and the second mounting bracket 16A, 16B and are thus connected with one another. The mounting brackets 16A, 16B are connected with the first tool holder 13 by means of screws 52 that are extending through bores 163 in the mounting brackets 16A, 16B and are screwed into threaded bores 1321 provided in the first tool holder 13, which comprises a mounting nose 132 that extends into the second mounting bracket 16A. The mounting brackets 16A, 16B each comprise a guide channel 162, in which guide noses 141A, 141E are slidably held, which are provided at both ends of the second tool holder 14. The second tool holder 14, which is seated at both ends on the elastic elements 18A, 188, is therefore slidably held by the mounting brackets 16A, 16B, An identification module 19 is provided on the second mounting bracket 16B, which comprises data of the modular tool unit 1 that can automatically be retrieved or interrogated after the modular tool unit 1 has been inserted.

The tool holders 13, 14 are formed in such a way that they can be equipped with suitable tool parts 11, 12. In the shown embodiment, the first tool part 13 comprises a channel-like tool cavity 131 into which the first tool part 11 can be laterally shifted with a first or second tool region 111, 112 of the first tool part 13 directed upwards. In FIG. 4*a* the front piece of the first tool part 11 is shown, which comprises on the upper side the first tool region 111 exhibiting a small tool groove and on the lower side the second tool region 112 exhibiting a broader tool groove.

The second tool holder 14 comprises a holding plate 142, which can be mounted with screws 51 in such a way that the second tool part 12, such as the shown rectangular blade, can be clamped within the second tool holder 14.

FIG. 5 shows a part of the device body 8 with the tool drive unit 2 and the tool bearing 3 as well as the control unit 6, which processes process data such as tool data, product data, process parameters, process factors and measurands obtained by sensors 61, . . . , 67 and which delivers corresponding control signals 601, 602, 603 to the drive devices 31, 41, 42.

In principle, it is possible, that all settings are entered by the user via an input device of the control unit 6, which can be a simple computer provided with input devices, output devices and interface modules. The screen menu structure shows that the user can select a suitable application A1, . . . , Ax. Further, the control unit 6 can be programmed in such a way, that the user can define a preferred configuration of the device 100. For example, the user can enter the type of the selected modular tool unit 1.

Preferably, the device 100 performs configuration procedures automatically. By means of an optional tool sensor 63 data are read from the identification module 19. By means of said data the control unit 6 can automatically select the related application procedures and can adjust the mounted modular tool unit 1 accordingly. By means of an optional temperature sensor 64 the ambient temperature and/or the temperature of the modular tool unit 1 can be measured, with which additional adjustments can be performed in order to compensate for thermal expansion. With an optional humidity sensor 65 the ambient humidity is measured, in order to determine the properties of the product more precisely. By means of a quality sensor 66, preferably a contactless sensor such as a capacitive sensor, the quality of the product, for example the thickness of the paper layer can be sensed. With this information the modular tool unit 1 can further be adjusted, in order to maintain optimised process procedures.

For the exchange of the modular tool unit 1 preferably a door sensor 61 is provided in the housing of the device 100, which detects the opening of the door, with which the tool compartment can be closed. Hence, the opening of the door can be signalled to the control unit 6, which subsequently controls the tool bearing 3 in such a way, that the bearing block 35 with the modular tool unit 1 is automatically driven back into the initial position. Then, the modular tool unit 1 can be removed and replaced. The correct placement of the new modular tool unit 1 is detected by means of the position sensor 62. After insertion of the new modular tool unit 1 the stepper motors 31 of the tool bearing 3 are actuated with regard to the retrieved tool data and the further process parameters.

Hence, the control unit 6 takes over all essential functions for adjusting the modular tool unit 1. Further, the control unit 6 controls the working processes according to a stored operation program. In order to synchronise the working processes performed by the at least one modular tool unit 1 with the transport processes performed by the transport or conveyer system, at least one product sensor 67 is provided, which detects the arrival of a product G so that the further transport of this product G within the device 100 can precisely be observed and controlled by the control unit 6.

After the detection of the product G the tool drive unit 2 is started at a first point in time, at which the zone G of the product to be processed is still remote from the modular tool unit 1. Subsequently the transport motor 41 is controlled in such a way that the product G is stopped at a second point in time, at which said zone G of the product to be processed has reached the position between the two tool parts 11, 12. Thereby, the first point in time is selected in such a way, that the tool parts 11, 12 act on the product G during the second point in time or shortly after. Immediately after the impact of the tool parts 11, 12 on the product G the transport motor 41 is restarted. In order to determine the suitable time for the restart, preferably the rotation angle of the drive shaft 21 is observed so that the separation of the tool parts 11, 12 at a third point in time can be detected. In this way, practically a continuous operation with high throughput and the advantage result that the products can be processed precisely and with simple measures.

LIST OF PARTS

1 modular tool unit
100 device for processing flat products
11 first tool part, e.g. the
111, 112 first and second tool region
12 second tool part, e.g. knife
13 first tool holder
131 tool cavity
132 mounting nose
1321 front bore in the mounting nose 132
133 side bores
14 second tool holder
141A/B guide noses
142 holding plate
1411 openings in the mounting plate 141
16A/B mounting brackets
161 transfer opening
162 guide channel
163 mounting bore
17 bridge element
171 openings in the bridge element 17
18A/B elastic elements, helical spring
19 identification module
2 tool drive unit
21 drive shaft
22A/B eccentrics
221 eccentric body
222 eccentric wheel
23A/B shaft bearing
3 tool bearing
3A, 3B drive units of the tool bearing
31 bearing drive unit
32 drive wheel
33 intermediate wheel
34 threaded bolt
341 locking ring
35 bearing block
351 tool channel
352 receiving opening
353 mounting opening
36 magnet

39 mounting frame
391 motor plate
392 gear box
393 threaded bore
41 transport motor
42 tool motor
51-55 screws
6 control unit
601-603 control signals
61 door sensor
62 position sensor
63 tool sensor
64 temperature sensor
65 humidity sensor
66 quality sensor
67 product sensor
71 input rollers
72 output rollers
8 device body
81 front-sided mounting plate
82 rear-sided mounting plate
811, 821 recesses
812, 822 mounting channels for the bearing block 35
83 transverse bars
91 transport belt
911, 912 transport wheels
92 tool belt
921 tool wheel
G products, separated sheets of paper
Z zone of the products to be processed

The invention claimed is:

1. Device for processing sheets of paper, cardboard or plastic, comprising:

a device body with at least one recess;

a removable modular tool unit having a longitudinal axis;

a tool drive unit that is connected to the device body and that comprises a tool drive motor;

a tool bearing that is connected to the device body and that includes at least one bearing drive unit with a bearing drive motor that is connected to a lifting device, which supports a bearing block;

the bearing block, which has a longitudinal axis that extends from a first end to a second end of the hearing block, is designed for receiving and holding the removable modular tool unit that is shiftable laterally through the recess in and out of the device body, with the longitudinal axis of the removable modular tool unit aligned in parallel to the longitudinal axis of the bearing block, which recess adjoins the first end of the bearing block;

a control unit controlling the bearing drive motor of the bearing drive unit and the tool drive motor of the tool drive unit independently from one another such that the removable modular tool unit is movable by the bearing drive unit towards the tool drive unit so that it is coupleable to and holdable in a distance from the tool drive unit in which the tool drive unit can interact with the removable modular unit;

the removable modular tool unit comprises at least one elastic element as well as a first tool holder and a second tool holder that are connected with one another and movable towards one another and that are held separated from one another by the at least one elastic element, which is arranged between the first tool holder and the second tool holder;

the first tool holder holding a first tool part and the second tool holder holding a second tool part;

the first tool part and second tool part serving for processing the sheets;

the modular tool unit is releasably held by the tool bearing and is movable by the bearing drive unit towards the tool drive unit under the control of the control unit into a position, wherein the first tool holder is fixedly held by the bearing drive unit, and wherein the second tool holder is coupled with the tool drive unit and can be moved by the tool drive unit forth and back towards the first tool holder which is fixedly held.

2. Device according to claim 1, wherein the bearing block comprises a tool channel for receiving the modular tool unit.

3. Device according to claim 1, wherein the bearing block comprises at least one magnet that is at least partially embedded in the bearing block, which magnet serves for holding the modular tool unit.

4. Device according to claim 3, wherein the first tool holder is connected on one side to a first mounting bracket and on the other side to a second mounting bracket, each mounting bracket comprising a guide channel, and wherein the second tool holder comprises on one side a first guide nose and on the other side a second guide nose, with the first guide nose slidably held in the guide channel of the first mounting bracket and the second guide nose slidably held in the guide channel of the second mounting bracket.

5. Device according to claim 3, wherein the first tool holder exhibits the form of a bar and is firmly or releasably holding the first tool part and wherein the second tool holder exhibits the form of a bar and is firmly or releasably holding a second tool part.

6. Device according to claim 3, wherein one of the mounting brackets is provided with a transfer opening, through which the first tool part can be transferred into a tool cavity provided in the first tool holder in such a way, that either a first or a second tool region of the first tool part is facing the second tool part.

7. Device according to claim 6, wherein elastic elements are held between the tool holders, with one of the elastic elements sitting on a bridge element, which forms a gate for the tool cavity of the first tool holder.

8. Device according to claim 3, wherein the tool bearing supports the first tool holder and the tool drive unit is coupled with the second tool holder or wherein the tool bearing supports the second tool holder and the tool drive unit is coupled with the first tool holder.

9. Device according to claim 1, wherein the tool drive unit comprises a drive shaft that holds at least one eccentric, which adjoins the modular tool unit when coupled thereto, or wherein the tool drive unit comprises a drive shaft that holds at least one eccentric, which is provided with a wheel bearing that rotatably holds a wheel, which adjoins the modular tool unit when coupled thereto.

10. Device according to claim 1, wherein the device body comprises two mounting plates that are connected to one another by transverse bars, the mounting plates each comprising a recess, into which the modular tool unit can be inserted, so that the modular tool unit is held within the recesses laterally without play but vertically movable.

11. Device according to claim 1, wherein the control unit is designed to process measurands provided by sensors or process parameters provided by the user, and to provide related control signals for the tool drive unit and for the bearing drive unit.

12. Device according to claim 11, wherein the modular tool unit comprises an identification module, which contains tool data of the modular tool unit that are retrievable by means of a tool sensor and transferable to the control unit, which is further designed to control the bearing drive unit depending on the tool data and further process data.

13. Modular tool unit for a device according to claim 1.

14. Device according to claim 1, wherein the first tool part is a knife and the second tool part is a die.

15. Device according to claim 1, wherein the removable modular tool unit comprises a first and a second holding member that are mounted and held on opposite sides of the first and the second tool holder only, and that hold the first and the second tool holder slidable against one another.

* * * * *